United States Patent [19]

Johnson

[11] 3,987,622

[45] Oct. 26, 1976

[54] LOAD CONTROLLED FLUID SYSTEM HAVING PARALLEL WORK ELEMENTS

[75] Inventor: Howard L. Johnson, Joliet, Ill.

[73] Assignee: Caterpillar Tractor Co., Peoria, Ill.

[22] Filed: Feb. 2, 1976

[21] Appl. No.: 654,482

[52] U.S. Cl. ..... 60/420; 60/427; 60/445; 60/484; 60/486

[51] Int. Cl.[2] ..... F15B 18/00; F15B 13/09

[58] Field of Search ..... 60/420, 427, 428, 445, 60/451, 452, 484, 486

[56] References Cited

UNITED STATES PATENTS

| | | | |
|---|---|---|---|
| 2,892,312 | 6/1959 | Allen et al. | 60/427 |
| 2,921,439 | 1/1960 | Krafft et al. | 60/427 |
| 2,936,712 | 5/1960 | Van Gerpen | 60/420 UX |

*Primary Examiner*—Edgar W. Geoghegan
*Attorney, Agent, or Firm*—Frank L. Hart

[57] ABSTRACT

Apparatus of a fluid system of a work vehicle for controlling the fluid delivered to parallel work elements of the vehicle in response to the load exerted on the fluid system by the work elements.

13 Claims, 2 Drawing Figures

LOAD CONTROLLED FLUID SYSTEM HAVING PARALLEL WORK ELEMENTS

BACKGROUND OF THE INVENTION

In the operation of a fluid system serving a plurality of parallel work elements, the work elements sometimes demand large volumes of fluid from their associated hydraulic fluid pump. Sometimes there arise situations where the work elements demand fluid at a rate greater than the capacity of the pump. In such situations, one or more of the work elements will be demanding more fluid than they are capable of receiving while another work element may be requiring fluid at a very high pressure in order to continue to function under its existing load. Since the fluid passing to the work elements is free to travel the path of least resistance, the above-mentioned work elements demanding additional fluid will be supplied the required fluid at the expense of denying the increased pressure demanded by said other work element.

This problem associated with a plurality of work elements connected in parallel can be avoided by providing a pump having a capcity greater than the total demand capacity that could ever be required by the work elements. However, to so construct the work vehicle would produce a waste of materials, time, and labor for constructing, maintaining, and handling the resultant large pump. Further, the undesirably large pump would add considerable extra weight to the vehicle and would require extra fuel to operate which would further represent a waste of energy.

It is therefore desirable to provide a fluid system apparatus which will control the system in a manner such that when the work elements approach a total fluid demand exceeding the capacity of the associated fluid pump, the actual demands of the work elements will be automatically overridden in response to a load pressure signal and fluid delivery to the individual work elements will be automatically, controllably maintained at reduced rates relative to their individual actual demand.

This invention therefore resides in controlling the fluid delivered to individual parallel work elements in response to a load pressure signal and the total fluid demand of the work elements relative to the maximum capacity of the pump.

DETAILED DESCRIPTION OF THE INVENTION

Figures 1, 2:
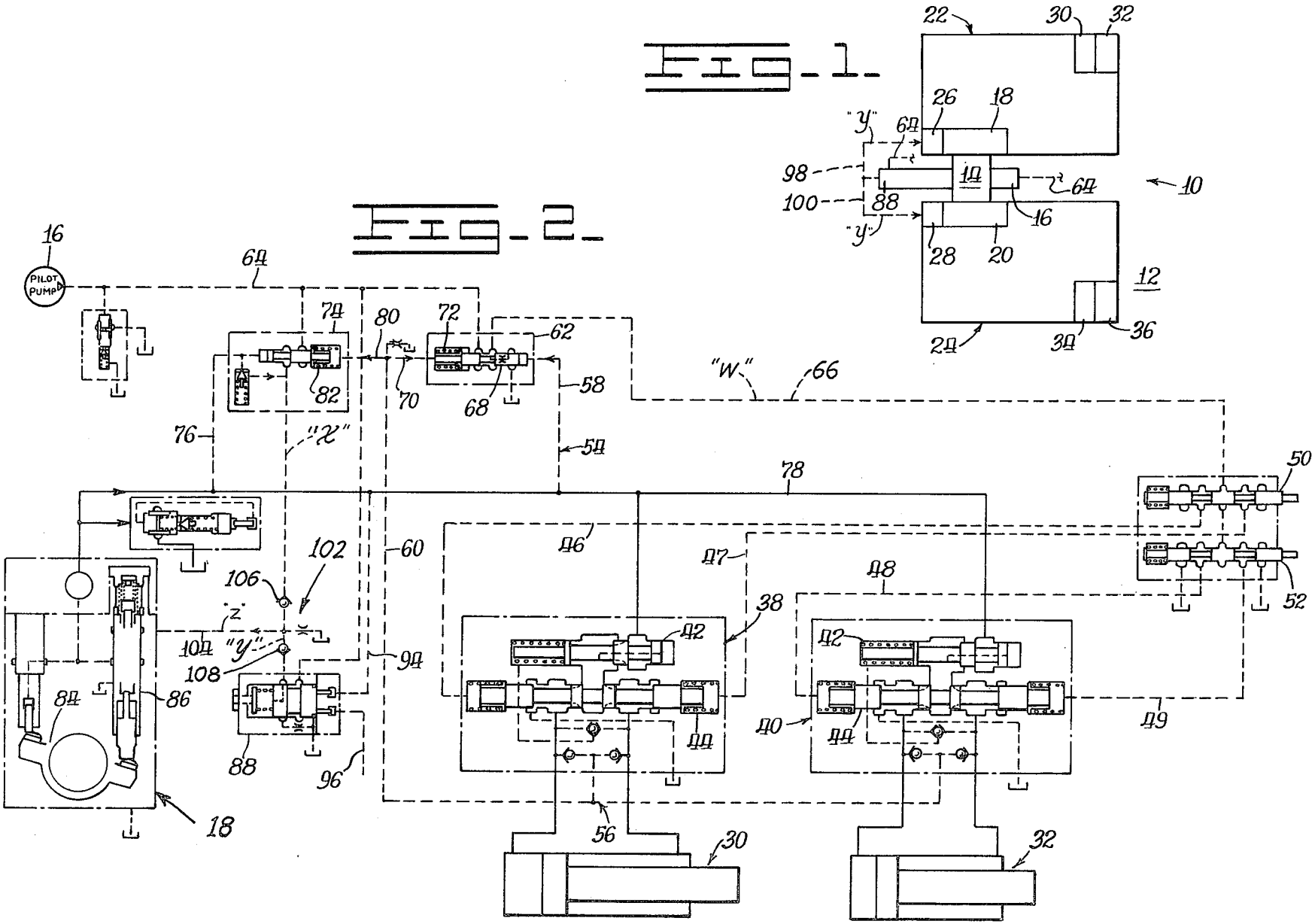
FIG. 1 is a diagrammatic view of one embodiment of a hydraulic system of this invention having a plurality of pumps each serving first and second circuits having a plurality of parallel work elements.
FIG. 2 is a diagrammatic more detailed view of one of the hydraulic circuits of FIG. 1 having another embodiment of control elements.

Referring to FIG. 1, a fluid system preferably a hydraulic system 10 of a work vehicle 12 has a power source 14, for example an engine, connected to a pilot pump 16 and one or more variable displacement hydraulic fluid pumps 18, 20 for delivering pilot pressure signals and hydraulic fluid. The hydraulic system 10 has one or more hydraulic circuits 22, 24 served by the pilot pump 16 and the power source 14.

Each hydraulic circuit 22, 24 has a variable displacement pump 18, 20, an associated pump control assembly 26, 28, and a plurality of different work elements 30, 32 and 34, 36.

FIG. 2 shows one of the hydraulic circuits 22 in greater detail. The elements of the first and second hydraulic circuits 22, 24 are generally common relative one to the other and only the first hydraulic circuit 22 will be described in detail for purposes of brevity.

Referring to FIG. 2, each hydraulic circuit, here circuit 22, has its respective plurality of work elements 30, 32 connected to the discharge of the pump 18. Each of the work elements 30, 32 has a control valve 38, 40.

Each of the control valves 38, 40 have a pressure compensated flow rate control element 42 and a flow direction control element 44. The control valves 38, 40 are positioned in the hydraulic fluid stream passing from the pump 18 to the respective work element 30, 32. Means of each control valves 38, 40 are movable between first and second positions for selectively substantially opening and closing valve outlets. Each control valve 38, 40 is opened and closed in response to respective pilot pressure signals delivered through respective lines 46, 47 and 48, 49 from a respective work element pilot control valve. The work element pilot control elements 50, 52 and control valves 38, 40 and their functions are well known in the art.

A first means 54 is provided for sensing the discharge pressure of the pump 18 and delivering a discharge pressure signal in response thereto. A second means 56 is associated with the plurality of parallel work elements 30, 32 for sensing the load pressure of each work element 30, 32 and delivering a load pressure signal responsive to the largest of said sensed load pressures. The discharge pressure signal is passed through line 58 and the load pressure signal is passed through line 60.

A demand margin valve 62 is connected by lines 64, 66 to the pilot pump 16 and the work element pilot control elements 50, 52 for controllably altering the magnitude of the pilot pressure signal from the pilot pump 16 and delivering a resultant pressure signal W through line 66 to said pilot control elements 50, 52.

The demand margin valve 62 has a spool 68 movable between substantially open and closed positions for altering the pilot pressure signal. The spool is moved in response to a preselected biasing force and the load pressure signal as opposed by the discharge pressure signal. Line 70 is connected to line 60 and to the demand margin valve 62 for delivering the load pressure signal from line 60 to the demand margin valve 62. The demand margin valve 62 is connected to line 58 for receiving the discharge pressure signal. The biasing element or spring 72 of the valve 62 provides the biasing force.

Control means 74 is provided for altering the magnitude of a pilot pressure signal and delivering a resultant signal X for controlling the respective pump 18. The pilot pressure signal is altered in response to a preselected biasing force and a load pressure signal as opposed by the discharge pressure signal. The control means 74 is connected to the discharge of the pump 18 via lines 76 and 78 and to the load pressure signal via line 80. The control means 74 is a valve of similar construction to valve 62 and has a biasing means such as a spring 82 for providing the preselected biasing force.

Each of the variable displacement pumps 18, 20 has a movable swash plate 84 for controlling the fluid discharge rate of the pump 18 and the respective pump control assemblies 26, 28 have a servo valve 86 for receiving a pressure signal and control flow to move the swash plate 84 in response to the received signal. Variable displacement pumps having associated servo valves are well known in the art.

In the above-described system, the signal X is delivered to the servo valve for controlling the discharge of the pump 18 in response thereto.

A third means 88 is provided in the hydraulic system 10 for altering the magnitude of a signal and delivering a resultant signal Y for controlling one or more of the pumps 18, 20. In the embodiment of FIG. 2, the third means 88 alters the pilot pressure signal in response to a preselected biasing force that is opposed by a pressure signal that is responsive to the power output of the power source 14. The pump discharge pressure which is a function of power output of the power source 14 is delivered to the third means 88 for opposing the biasing force.

In the embodiment of FIG. 1, the third means 88 senses the power output of the power source, develops a signal in response thereto, controllably alters the magnitude of the developed signal in response to a biasing force opposing said signal, and delivers a resultant signal Y from the third means 88 via lines 98, 100 to the respective pump control assemblies 26, 28 of the respective pumps 18, 20. In the embodiment of FIG. 1, the third means can be, for example, a summing valve as is known in the art.

As set forth above, it should be understood that the third means 88 can be utilized for controlling a single pump or a plurality of pumps without departing from this invention.

The hydraulic system 10 can therefore have one or a plurality of circuits 22, 24 each associated with a separate pump 18, 20. Each pump 18, 20 can be controlled by a resultant signal X or by a resultant signal Y as set forth above. In a preferred embodiment, as shown in FIG. 2, each circuit 22, 24 has a fourth means 102 for sensing the associated signals X and Y of respective lines 98, 100 and delivering the largest of said sensed signals as a resultant signal Z for controlling the respective pump 18, 20. As shown, the fourth means can be a pair of check valves 106, 108. The signals X or Y or Z are delivered to servo valve 86 for biasing the associated swash plate 84 and controlling the fluid discharge rate of the pump, as is known in the art.

In the operation of this invention, the servo valve 86 of a pump is biased by a resultant pressure signal X or Y or Z for controlling the discharge rate of the pump through the swash plate. In each embodiment, the pump control assembly is further controlled indirectly by the demand margin valve 62 altering the pilot pressure signal in response to a pump discharge pressure signal as opposed by its preselected biasing force and the largest load pressure signal of the work elements.

At operational conditions where the capacity of the pumps are satisfying the fluid and pressure demands of all the work elements, the various control elements of this invention control the operation of the pump to automatically meet these demands.

Since the work elements are connected in parallel, fluid from the pump will follow the path of least resistance where fluid demand is greater than pump capacity. Therefore, if work elements 30, 32 are demanding fluid at a rate greater than the discharge capacity of the pump 18 and one of the work elements 30, for example, is under heavy load, the other work element 32 will be the path of least resistance for the fluid, fluid will selectively flow to element 32 and fluid pressure cannot build to a value sufficient to operate element 30 which is under the heavy load conditions.

This problem is solved by this invention without providing pumps that have excessive discharge capacity over what is generally needed under routine operating conditions.

As the hydraulic system circuit approaches maximum capacity of the pump and the work elements are requiring more fluid than they are receiving, the largest load pressure signal from element 30 will cause the pilot pressure signal to be altered by the demand margin valve and the resultant pressure signal W to be decreased in response to said load pressure signal. In effect, this will cause the demands made through each work element pilot control element to be "overridden". Although a pilot control element 50, for example, may be signaling for maximum fluid, the lowering of signal W will cause the control signals from each pilot control element 50, 52 passing through respective lines 46, 47 and 48, 49 to be altered for controllably reducing through control valve means 38, 40 the fluid deliverable to work elements 30, 32. Therefore, as the fluid delivered to work element 32 decreases in response to the decreased work signal W, the pump is capable of delivering the needed fluid pressure to work element 30 for the operation thereof.

By so constructing this system, the disadvantage of connecting the work elements in parallel is overcome while avoiding the waste associated with providing a pump which will be operated below maximum capacity much of the time.

Further control is provided by the various embodiments which utilize resultant signals X, Y, or Z as control signals to the servo valve, as set forth above, in combination with the control provided by altering signal W.

Other aspects, objects and advantages can be obtained from a study of the drawings, the disclosure, and the appended claims.

What is claimed is:

1. In a fluid system of a work vehicle having a power source, a pilot pump connected to the power source for delivering pressure signals and at least one fluid circuit having a variable displacement pump connected to the power source, a pump control assembly, and a plurality of different work elements each connected in parallel through a respective control valve to the discharge of the pump, said control valves each being movable between substantially closed and open positions in response to a pilot pressure signal as controlled by a respective work element pilot control valve, the improvement comprising:

first means for sensing the discharge pressure of the pump and delivering a discharge pressure signal in response thereto;

second means associated with the plurality of parallel work elements for sensing the load pressure of each work element and delivering a load pressure signal responsive to the largest of said sensed load pressures; and a demand margin valve positioned in the pathway of a pilot pressure signal at a location upstream of the work element pilot control valves, said demand margin valve being movable between substantially open and closed positions in response to a biasing force and the load pressure signal as opposed by the discharge pressure signal for controllably altering the magnitude of the pilot pressure signal and delivering a resultant pressure signal W to the plurality of work element pilot control valves.

2. Apparatus, as set forth in claim 1, wherein each fluid circuit includes:

control means for altering the magnitude of a pilot pressure signal in response to a biasing force and the load pressure signal as opposed by the discharge pressure signal and delivering a resultant signal X for controlling the output of the respective pump.

3. Apparatus, as set forth in claim 2, wherein the variable displacement pump of each fluid circuit has a movable swash plate for controlling the fluid discharge rate of the pump and the pump control assembly has a servo valve for receiving the signal X and controlling flow to move the swash plate in response thereto.

4. Apparatus, as set forth in claim 1, wherein there are at least two fluid circuits each connected to the pilot pump and being of common construction relative one to the other.

5. Apparatus, as set forth in claim 4, wherein the fluid system includes:

third means for controllably altering the magnitude of a pilot pressure signal in response to a biasing force opposed by the discharge pressures of the pumps and delivering a resultant signal Y for controlling the output of each pump.

6. Apparatus, as set forth in claim 5, wherein each variable displacement pump of each fluid circuit has a movable swash plate for controlling the fluid discharge rate of a respective pump and each pump control assembly has a servo valve for receiving the signal Y and controlling the flow to move the swash plate in response thereto.

7. Apparatus, as set forth in claim 5, wherein each fluid circuit includes:

control means for altering the magnitude of a pilot pressure signal in response to a biasing force opposed by the load pressure signal and delivering a resultant signal X for controlling the output of a respective pump; and fourth means for sensing the resultant signals X and Y and delivering the largest of said sensed signals as a resultant signal Z for controlling the output of the respective pump.

8. Apparatus, as set forth in claim 7, wherein each variable displacement pump of each fluid circuit has a movable swash plate for controlling the fluid discharge rate of a respective pump and each pump control assembly has a servo valve for receiving the signal Z and controlling flow to move the swash plate in response thereto.

9. Apparatus, as set forth in claim 1, wherein the fluid system includes:

third means for sensing the power output of the power source developing a signal in response thereto, controllably altering the magnitude of the signal in response to a biasing force opposing said signal, and delivering a resultant signal Y for controlling the output of the pump.

10. Apparatus, as set forth in claim 1, wherein the fluid system includes:

at least two fluid circuits each connected to the pilot pump and being of common construction relative one to the other;

third means for sensing the power output of the power source developing a signal in response thereto, controllably altering the magnitude of the signal in response to a biasing force opposing said signal and delivering a resultant signal Y for controlling the output of each pump.

11. Apparatus, as set forth in claim 10, wherein each variable displacement pump of each fluid circuit has a movable swash plate for controlling the fluid discharge rate of a respective pump and each pump control assembly has a servo valve for receiving the signal Y and controlling flow to move the swash plate in response thereto.

12. Apparatus, as set forth in claim 10, wherein each fluid circuit includes:

control means for altering the magnitude of a pilot pressure signal in response to a biasing force opposed by the load pressure signal and delivering a resultant signal X for controlling the output of a respective pump; and fourth means for sensing the resultant signals X and Y and delivering the largest of said sensed signals as a resultant signal Z for controlling the output of a respective pump.

13. Apparatus, as set forth in claim 12, wherein each variable displacement pump of each fluid circuit has a movable swash plate for controlling the fluid discharge rate of a respective pump and each pump control assembly has a servo valve for receiving the signal Z and controlling flow to move the swash plate in response thereto.

* * * * *